United States Patent [19]

Fabrig

[11] Patent Number: 4,457,655

[45] Date of Patent: Jul. 3, 1984

[54] METHOD AND APPARATUS FOR ASSEMBLING PRONGED BINDING STRIPS WITH STACKS OF PAPER SHEETS OR THE LIKE

[75] Inventor: Paul Fabrig, Neuffen, Fed. Rep. of Germany

[73] Assignee: Womako Maschinenkonstruktionen, Nürtingen, Fed. Rep. of Germany

[21] Appl. No.: 317,943

[22] Filed: Nov. 4, 1981

[30] Foreign Application Priority Data

Nov. 8, 1980 [DE] Fed. Rep. of Germany ..... 3042183
May 5, 1981 [DE] Fed. Rep. of Germany ..... 3117659

[51] Int. Cl.[3] ..... B42C 19/00; B21F 45/00

[52] U.S. Cl. ..... 412/7; 140/71 R; 412/34; 412/39

[58] Field of Search ..... 140/71 R, 105; 412/7, 412/33, 34, 39

[56] References Cited

U.S. PATENT DOCUMENTS

| | | | |
|---|---|---|---|
| 2,097,888 | 11/1937 | Leyerle | 412/39 |
| 2,117,242 | 5/1938 | Eramo | 412/39 |
| 2,555,290 | 5/1951 | November | 412/39 |
| 3,334,918 | 8/1967 | Pigna et al. | 412/7 |
| 3,555,587 | 1/1971 | Seaborn | 412/7 |
| 3,566,927 | 3/1971 | Adams | 140/71 R |
| 4,020,516 | 5/1977 | Gomez | 412/39 |
| 4,281,690 | 8/1981 | Lemburg | 412/39 X |

FOREIGN PATENT DOCUMENTS

| | | | |
|---|---|---|---|
| 109384 | 4/1968 | Denmark | 412/39 |
| 2403155 | 7/1974 | Fed. Rep. of Germany | 412/39 |
| 1542471 | 10/1968 | France | 412/39 |

*Primary Examiner*—Paul A. Bell
*Attorney, Agent, or Firm*—Peter K. Kontler

[57] ABSTRACT

Stacks of marginally perforated paper sheets are assembled with prefabricated C-shaped binding strips at timely spaced intervals by moving two or more stacks simultaneously to a binding station so that the perforations of their sheets form a row, moving at the same intervals a strand of coherent strips lengthwise and cutting groups of discrete strips from the leader of the strand at a severing station which is remote from the binding station, transferring successive groups from the severing station to the binding station including moving the strips of each group sideways at least once and spreading the strips of each group by moving at least some strips of the group axially and away from the neighboring strips, and inserting the strips of a group into and closing the strips of such group in the perforations of stacks of sheets at the binding station. The apparatus can make stationery articles with one-piece binders or with so-called skip binders consisting of two or more spaced-apart coaxial binders. The devices which close the stips at the binding station also serve to deliver the groups of strips to the binding station, either from the spreading station or from an intermediate station which is located between the spreading and binding stations.

61 Claims, 12 Drawing Figures

53
54
51
50
58
59
61
E, F
62
70'
69'
CA
DB
64'
CAR
G
63'
68'
67'
72
52
46
66A
16
14
67"
68"
63"
7a'...7f'
66
64"
CA
DB
69"
70"
7a...7f
57
56
43a....43f
48f
48e
40
D
48d
48c
48b
48a
44a...44f
47
49
49a
45
55
20
42
C
46a
22
4
17
19
18
27a....27f
29
31'
32
28
33
34
31"
21
36
37
26
23
24
71'
64'
7a'....7f'
P1
P2
A
64"
71"
41
39
38

Fig.9
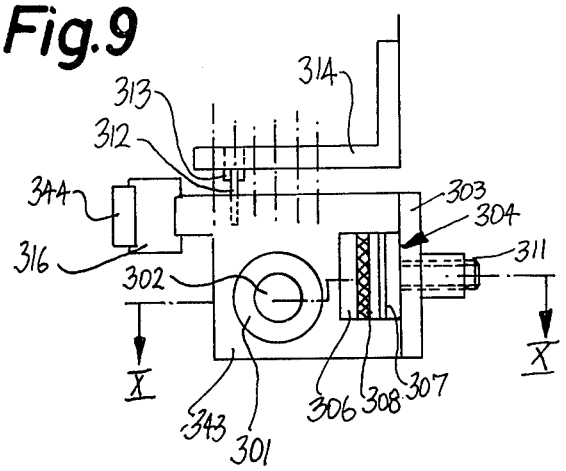
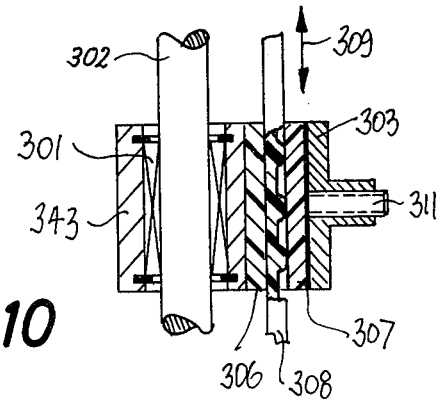
Fig.10

METHOD AND APPARATUS FOR ASSEMBLING PRONGED BINDING STRIPS WITH STACKS OF PAPER SHEETS OR THE LIKE

BACKGROUND OF THE INVENTION

The present invention relates to a method of and to an apparatus for making stationery articles, such as steno pads, exercise books, calendars or like commodities wherein the sheets of stacks of overlapping sheets are held together by one or more pronged binding strips of the type known as wire-O (trademark). More particularly, the invention relates to improvements in a method and apparatus for making stationery articles by transporting a continuous strand of coherent binding strips having a generally C-shaped cross-sectional configuration to a severing station where the strand is subdivided into discrete strips and the thus obtained strips are thereupon transported sideways (i.e., transversely of their axes) toward a binding or inserting station where the prongs of the strips are introduced into the perforations of stacked paper sheets or the like.

U.S. Pat. No. 3,883,916 granted May 20, 1975 to Adams et al. discloses a machine for binding stacks of perforated sheets wherein a strand of coherent binding strips is fed axially to a severing station at which a tool severs successive strips, one at a time, and the thus obtained strips are moved sideways through a channel by a pusher bar, first onto a guide and thence into the range of carrier bar having magnetic attracting elements for the strip. An arm thereupon pivots the carrier bar about an axis which is parallel to the axis of the binding strip so that the strip enters a binding station and is closed by a pair of closing tools of the type disclosed in U.S. Pat. No. 3,451,051 granted June 24, 1969 to Liouville. The prongs of the strip penetrate into the perforations of the stationery article at the binding station so that the strip is converted into a generally tubular binder which allows the sheets or pages of the article to turn about the axis of the binder.

A drawback of the machine which is disclosed in the aforementioned patent to Adams et al. is that the number of stationery articles which can be turned out per unit of time is relatively low because the tool at the severing station is designed to separate from the continuous strand a single binding strip at a time, and that the number of strips cannot be increased at will since the strand is severed while its conveyor is at a standstill, i.e., the number of starts and stoppages of the conveyor cannot be increased to the extent which would permit the production of a large number of stationery articles per unit of time. The patented machine exhibits the additional drawback that it cannot be used for the making of stationery articles which employ so-called skip binders, namely, composite binders each of which consists of two or more aligned and spaced apart binding strips. Reference may be had to U.S. Pat. No. 3,555,587 granted Jan. 19, 1971 to Seaborn et al. FIG. 4 of this patent shows a stationery article wherein the sheets are held together by a skip binder consisting of three spaced-apart coaxial binding strips. Thus, in lieu of using a continuous binding strip which extends along the entire row of perforations in one marginal portion of a stack of sheets, a skip binder employs several shorter binding strips with attendant savings in the material of the binder. A feature of the machine which is disclosed by Seaborn et al. is that the binding strips are moved into engagement with the perforations of a stack of sheets while the stack moves along a predetermined path. As regards the manner of inserting the prongs of the binding strips into the perforations of the adjacent stacks of sheets, Seaborn et al. refer to U.S. Pat. No. 3,334,918 granted Aug. 8, 1967 to Pigna et al. The patent to Pigna et al. discloses an apparatus wherein the binding strips move with the respective stacks during insertion of prongs into the adjacent perforations, such insertion taking place by rotating the binding strips about their respective axes. Each of the above-discussed patents discloses the making of a single stationery articles at a time.

OBJECTS AND SUMMARY OF THE INVENTION

An object of the invention is to provide a novel and improved method of making stationery articles of the type wherein stacks of perforated sheets or pages are held together by pronged binders.

Another object of the invention is to provide a method which renders it possible to produce large numbers of such stationery articles per unit of time.

A further object of the invention is to provide a novel and improved method of making stationery articles with one-piece or composite (skip) binders.

An additional object of the invention is to provide a method of simultaneously producing several stationery products of the type wherein the sheets, panels or pages are held together by pronged binders.

Still another object of the invention is to provide a novel and improved apparatus for the practice of the above outlined method.

A further object of the invention is to provide an apparatus which can be utilized for the making of stationery articles with one-piece of composite pronged binders.

An additional object of the invention is to provide the apparatus with novel and improved system for conveying pronged binding strips to the binding station where the strips are assembled with stacks of paper sheets or the like.

Still another object of the invention is to provide the apparatus with novel and improved means for severing a continuous strand of coherent pronged binding strips so that the strand yields discrete binding strips for the making of stationery articles with one-piece or composite (skip) binders.

A further object of the invention is to provide the apparatus with novel and improved means for manipulating the severed binding strips downstream of the severing station and in the course of insertion into the perforations of stacked paper sheets or the like.

Another object of the invention is to provide the apparatus with novel and improved means for properly orienting the binding strips at the binding station and with novel and improved means for reproducibly closing the binding strips at the binding station so that each binding strip is converted into a substantially tubular body which prevents the removal of sheets from the finished stationery article but permits the sheets to turn through angles of selected magnitude.

An additional object of the invention is to provide the apparatus with simple, compact and reliable system for conveying discrete binding strips or groups of discrete binding strips from a conveyor to the binding station.

One feature of the present invention resides in the provision of a method of binding the marginally perforated sheets of stacks of overlapping sheets by substantially C-shaped pronged prefabricated binding strips. The method comprises the steps of advancing a strand of coherent binding strips lengthwise along a predetermined path, supplying stacks of sheets to a binding station which is remote from the path for the strand, simultaneously severing groups of at least n discrete binding strips from the strand in a predetermined portion of the path, transferring the strips of successive groups from the path to the binding station including moving the strips of successive groups sideways and spreading the strips of successive groups (the spreading step includes moving at least one strip of each group axially and away from the neighboring strip of the same group), and introducing the spread-apart strips of successive groups into and closing such strips in the perforations of sheets of stacks at the binding station.

The advancing step preferably includes moving the strand of coherent binding strips stepwise at timely spaced intervals (in synchronism with movements of other parts in the machine or production line in which the apparatus for the practice of my method is installed), and the severing step then includes separating at least n discrete binding strips from the leader of the strand during each period of dwell of the strand between successive intermittent movements along the path. The supplying step can include delivering (e.g., by means of a turret or another suitable conveyor) to the binding station at least n stacks of sheets in such orientation that the perforations of sheets at the binding station form a single row. The delivering step preferably includes supplying to the binding station at least n stacks of sheets at the same timely spaced intervals at which the groups of discrete strips are formed in the predetermined portion of the path for the strand of coherent strips.

If the method is to be practiced for the manufacture of stationery articles having so-called skip binders wherein the sheets of each stack are held togehter by two or more coaxial but spaced apart binding strips, the supplying step includes or can include delivering to the binding station m stacks of sheets at the aforementioned timely spaced intervals, and each group of strips then comprises $m \times n$ discrete strips so that each stack at the binding station is or can be connected with n spaced-apart binding strips. The number n can be a whole number which can exceed m; for example, m can equal two and n can equal three.

In accordance with a presently preferred embodiment of the method, the transferring step includes moving successive groups of strips axially intermediate the predetermined portion of the path and the binding station. For example, the transferring step can consist of the following steps which are carried out one after the other: (a) moving successive groups of strips sideways away from the predetermined portion of the path for the strand of coherent strips, (b) spreading successive groups of strips in the aforementioned manner, (c) moving successive groups of spread-apart strips sideways, (d) moving successive groups of spread-apart strips axially, and (e) moving successive groups of spread-apart strips sideways (i.e., at right angles to the axes of the strips of a group) to the binding station.

If the number of strips in a group equals n, the spreading step can include moving $n-1$ strips of each group axially and away from each other through different distances. If the number of strips in a group equals $m \times n$, the number of strips which are moved axially and away from the neighboring strips can equal $m \times n-1$, i.e., one strip of each group can retain its axial position in the course of the spreading step.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 9 shows a detail in an apparatus which constitutes a modification of the apparatus shown in FIG. 2, and more specifically a slidable carrier which supports a discrete binding strip at the spreading station where the binding strips of a group are separated from each other on their way toward the binding station; and FIG. 10 is a sectional view as seen in the direction of arrows from the line X—X of FIG. 9.

DESCRIPTION OF THE PREFERRED EMBODIMENTS

Figures 1, 1A, 1B, 4:
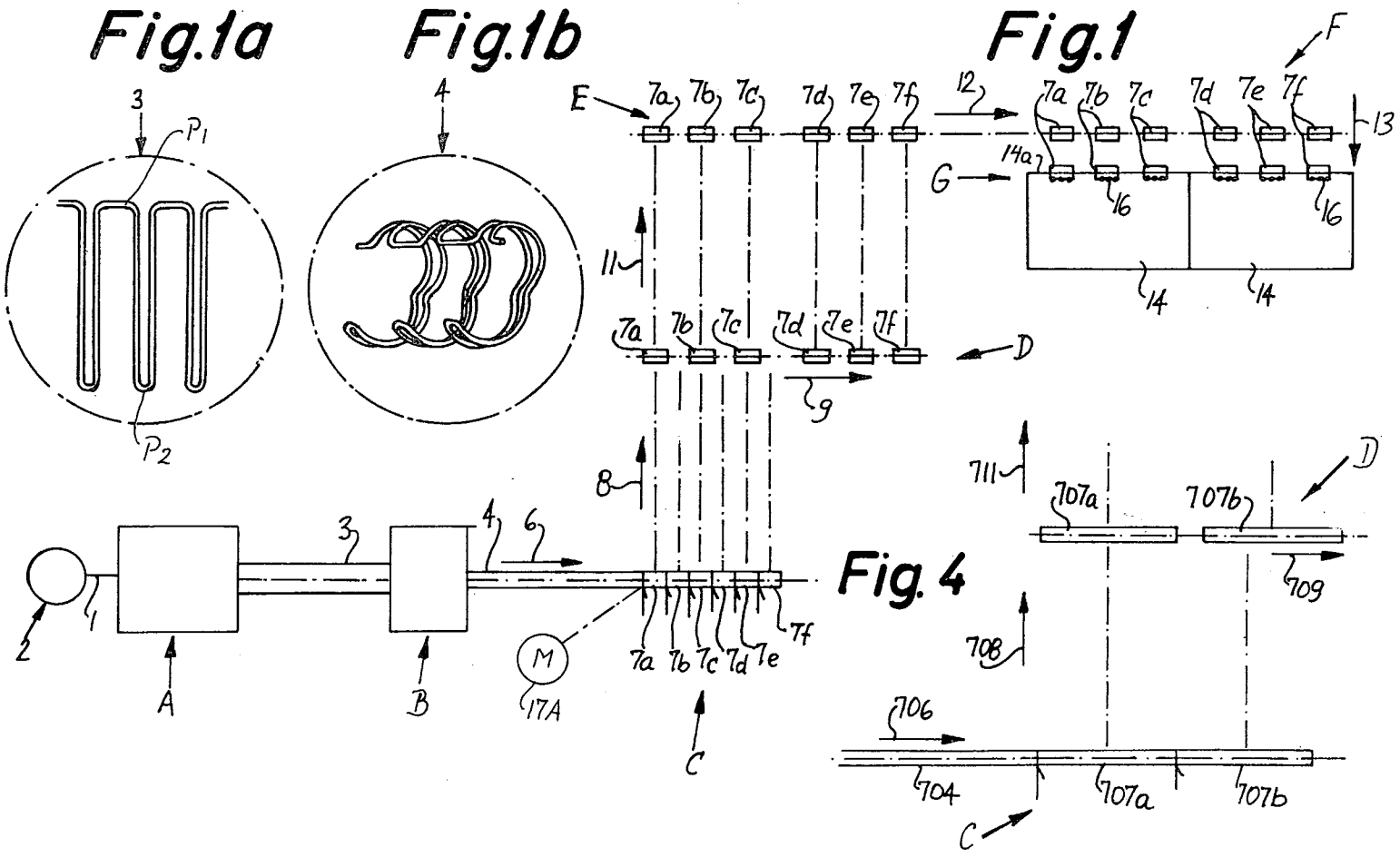
FIG. 1 is a schematic plan view of an apparatus which can be utilized for the practice of one embodiment of the improved method and is designed for the making of stationery articles wherein stacked sheets are held together by sets of two or more coaxial pronged binders.
FIG. 4 is a fragmentary schematic plan view of an apparatus which is utilized for the making of stationery articles with one-piece pronged binders.

Referring first to FIG. 1, there are shown certain components and units of an apparatus which embodies one form of the invention and is designed to produce so-called skip binders each of which consists of three aligned deformed binding strips *7a*, *7b*, *7c* or *7d*, *7e*, *7f*. The apparatus comprises a barrel 2 or another suitable source of wire 1 which consists of or contains magnetizable material and is drawn from such source in a direction to the right, as viewed in FIG. 1, and into a first bending station A accommodating a machine which converts the wire into a flat comb-like body 3 of meandering shape. The machine at the bending station A may be of the type disclosed in U.S. Pat. No. 4,165,767 granted Aug. 28, 1979 to Seaborn et al. The continuous body 3 is thereupon caused to pass through a second bending station B which accommodates a machine serving to convert the body 3 into a continuous strand 4 having a substantially C-shaped cross-sectional configuration (reference may be had to FIG. 2 of the aforementioned patent to Liouville). The machine at the second bending station B may comprise a press with a stationary patrix, a reciprocable matrix and a conveyor which transports the body 3 in stepwise fashion so that the matrix cooperates with the patrix during each interval of idleness of the conveyor in order to convert successive sections of the body 3 into successive increments of the strand 4. Alternatively, the machine at the bending station B may be of the type disclosed in U.S. Pat. No. 4,281,690 granted Aug. 4, 1981 to Lemburg. For the sake of simplicity, the disclosures of the patents to Seaborn et al. (767) and Lemburg are incorporated herein by reference. The station B constitutes a source of the strand 4.

Figures 2, 3:
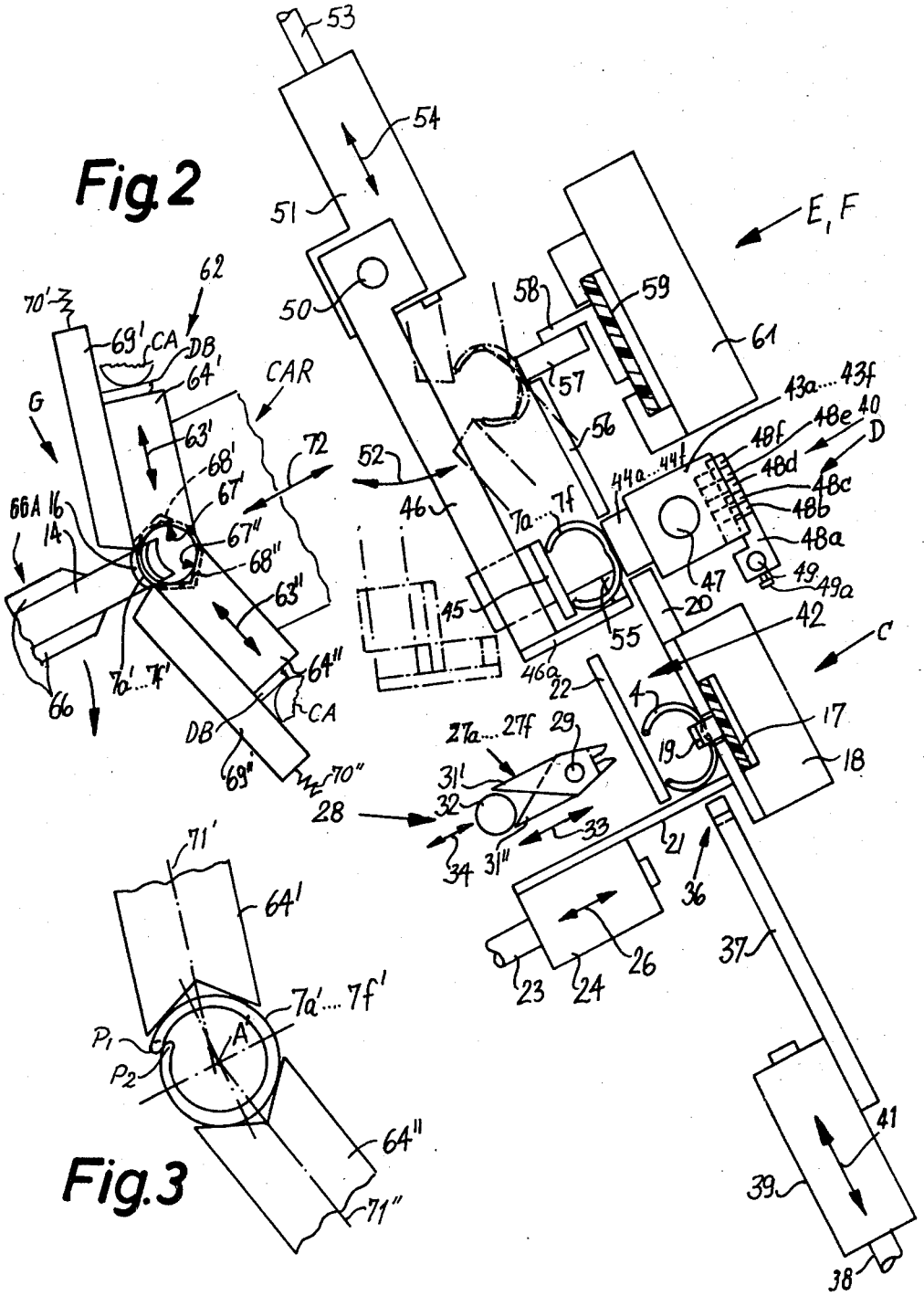
FIG. 2 is a fragmentary partly elevational and partly sectional view of those portions of the apparatus which are utilized for severing the strand, transferring groups of discrete binding strips from the severing station to the binding station, and introducing the groups of strips into and closing the strips in the perforations of stacked sheets at the binding station.
FIG. 3 is an enlarged fragmentary end elevational view of portions of devices which convey groups of binding strips to the binding station and thereupon insert the strips into and close the strips in the perforations of stacked sheets at the binding station.

The prongs of the strand 4 are engaged and entrained by a suitable conveyor 17 (see the right-hand portion of FIG. 2) which is operated to advance the strand 4 in stepwise fashion along a predetermined path, always through increments of predetermined length, namely, through increments corresponding to the combined length of six discrete binding strips *7a* to *7f*. The direction in which the conveyor 17 advances the strand 4 is indicated by the arrow 6. The leader of the strand 4 is subdivided into six identical binding strips *7a* to *7f* at a severing station C the details of which are shown in FIG. 2.

The body 3 between the two bending stations A and B preferably forms a loop, and the apparatus preferably comprises suitable monitoring means (e.g., a dancer roll which rests in the bight of the loop and is operatively connected with a signal generating device, such as a variable resistor or potentiometer) which regulates the speed of the machine at the first bending station A so as to ensure that an adequate supply of flat comb-like material is available in the space between the stations A and B.

Analogously, the strand 4 between the stations B and C can form a loop whose dimensions are monitored for the purpose of regulating the operation of machines at the stations A and B. The monitoring means can initiate stoppage and renewed starting of the prime mover of the machine at the first bending station A and/or at the second bending station B, depending on the rate at which the apparatus is to form stationery articles each of which has a stack of perforated sheets or panels and several pronged binders for holding the sheets together.

The freshly severed group of six binding strips *7a* to *7f* is transported from the severing station C in a direction (note the arrow 8) at right angles to the axes of such strips and to a spreading or expanding station D wherein the neighboring strips of such group are separated from each other by moving the strips *7b* through *7f* in the direction which is indicated by arrow 9, i.e., in the direction of the common axis of the strips *7a* to *7f* and through different distances in a direction away from the strip *7a*. The illustrated mode of separating the strips *7a* to *7f* of a group of six aligned strips is but one of several modes which can be resorted to in the practice of the method of the present invention. For example, all six strips *7a* to *7f* of a group can be moved axially in the same direction. Alternatively some of the strips can be moved in the direction which is indicated by the arrow 9, and the remaining strips can be moved counter to such direction. Still further, the strips of a complete group of six strips *7a* to *7f* can be transported directly to a binding station G and moved apart during travel toward the binding station or upon arrival at such station.

After leaving the spreading station D, the six spaced-apart strips *7a* to *7f* are transferred to the aforementioned binding station G. Such transfer can take place directly or through one or more additional or intermediate stations, such as the stations E and F shown in FIG. 1. If the transfer of a group of spread-apart strips *7a* to *7f* takes place directly from the station D to the station G, these two stations are preferably positioned in such a way that the strips are moved sideways, i.e., transversely of their axes. The provision of one or more intermediate stations (such as E and F) is preferred in many instances because this allows for a simplification of the design of conveyor means for transporting stacks 14 of overlapping perforated sheets to the binding station G. More specifically, this renders it possible to employ for the stacks 14 conveyor means which are identical or analogous to those used in heretofore known apparatus for making calendars, steno pads, exercise books and analogous stationery articles wherein the sheets are held together by pronged binders. As a rule, or at least in certain instances, direct transport of spread-apart groups of binding strips *7a* to *7f* from the spreading station D to the binding station G would necessitate an increase in the height of the apparatus which, in turn, would adversely affect the convenience of access to certain units and/or the convenience of elimination of certain types of malfunctions.

In the embodiment which is illustrated schematically in FIG. 1, the groups of spread-apart binding strips *7a* to *7f* are transported sideways from the spreading station D to the first intermediate station E (note the arrow 11) and thereupon axially (note the arrow 12) from the station E to the second intermediate station F which is adjacent to but still spaced apart from the binding station G. The last stage of transport of groups of binding strips *7a* to *7f* from the station D to the station G (namely, from the station F to the station G) takes place in a direction at right angles to the axes of the strips (note the arrow 13 in the upper right-hand corner of FIG. 1). Within a group, the positions of the strips *7a* to *7f* with reference to each other can remain unchanged during each and every stage of transport from the spreading station D to the binding station G.

The station G receives pairs of aligned stacks 14 at the same rate at which the transfer mechanism delivers groups of strips *7a* to *7f* from the second intermediate station F to the binding station G. The alignment of the pairs of stacks 14 is such that the perforations 16 in their registering marginal portions 14*a* form a straight row. The manner in which the prongs of the binding strips *7a* to *7f* at the station G are introduced into the adjacent perforations 16 and in which the binding strips are converted into substantially cylindrical binders is not shown in detail in FIG. 1.

FIG. 2 shows certain details of an apparatus which can be utilized for the practice of the improved method. As mentioned hereinabove, the means for delivering the strand 4 from the second bending station B to the severing station C comprises a conveyor 17 which is an endless toothed belt conveyor one stretch or reach of which is guided by a support 18. The illustrated stretch of the conveyor 17 serves to transport the strand 4 to the severing station C; the other or return reach of the conveyor 17 is not shown in FIG. 2. The means for intermittently driving the conveyor 17 is indicated in FIG. 1, as at 17A. The conveyor 17 comprises tooth-spaced projections or protuberances 19 constituting entraining elements which engage the adjacent prongs of the strand 4 and transport the strand toward and into the severing station C.

The apparatus further comprises adjustable guide members 21 and 22 which ensure that the strand 4 remains in a predetermined path during travel toward as well as during dwell of its increments or sections at the severing station C. At the station C, the guide member 21 is supported by a carriage 24 which is reciprocable along an elongated guide rod 23 in directions indicated by a double-headed arrow 26. The means (such as a rack-and-pinion drive or fluid-operated double-acting cylinder and piston unit) for reciprocating the carriage 24 between a first end position which is shown in FIG. 2 (and in which the guide member 21 is held in its operative position, namely, in contact with the strand 4) and a second end position in which the guide member 21 is retracted in a direction to the left, as viewed in FIG. 2, so as to allow for transfer of a freshly formed group of binding strips 7*a* to 7*f* from the severing station C to the spreading station D (arrow 8 in FIG. 1), is not shown in the drawing. The guide member 22 is or can remain stationary and is formed with suitable cutouts (not specifically shown) to permit entry of six severing tools 27*a* to 27*f* into the station C. The tools 27*a* to 27*f* are disposed one behind the other, as considered in the axial direction of the strand 4 at the station C, and together constitute a severing unit 28 which subdivide successive increments or sections of the strand 4 into groups of six binding strips 7*a* to 7*f* each.

Each of the severing tools 27*a* to 27*f* comprises two knives 31′, 31″ which are pivotable about the axis of a shaft 29 and resemble the blades of shears. All of the severing tools 27*a* to 27*f* are movable in directions indicated by a double-headed arrow 33, namely, toward and away from the severing station C and at right angles to the longitudinal direction of that portion or section of the strand 4 which is located at the station C. Such movements of the tools 27*a*–27*f* are shared by a rod-shaped actuating member 32 which is further movable with reference to the knives 31′ and 31″ of the tools 27*a*–27*f* (note the double-headed arrow 34 in FIG. 2). The actuating member 32 is caused to move in a direction toward the adjacent rear legs of the knives 31′, 31″ when the tools 27*a*–27*f* are located at the severing station C so that the cutting edges of the knives 31′ and 31″ sever the strand 4 whereupon the tools 27*a*–27*f* are retracted from the station C, either before or after the actuating member 32 is retracted to the illustrated inoperative position with reference to the knives 31′ and 31″.

When a severing operation is completed and the tools 27*a*–27*f* are retracted from the severing station C, the carriage 24 retracts the guide member 21 and a pusher 37 is shifted upwardly, as viewed in FIG. 2, to transfer the freshly formed group of six coaxial binding strips 7*a*–7*f* from the station C to the spreading station D. To this end, the pusher 37 has a front end face formed with a row of teeth 36 analogous to the projections 19 on the conveyor 17 and serving to engage the prongs of the binding strips 7*a*–7*f* during transport along the exposed side of the support 18 and toward the station D. The means for reciprocating the pusher 37 in directions indicated by a double-headed arrow 41 comprises a carriage 39 which is mounted on and can slide along an elongated guide rod 38. The means for reciprocating the carriage 39 along the guide rod 38 may comprise a rack-and-pinion drive, a fluid-operated double-acting cylinder and piston unit, or any other suitable motor means, not shown.

When the pusher 37 performs an upward stroke, as viewed in FIG. 2 (while the guide member 21 is held in the retracted position), the teeth 36 advance a freshly separated group of binding strips 7*a*–7*f* through a channel 42 which is defined in part by the conveyor support 18, in part by the guide member 22, and in part by a further guide member 20 in the form of a strip which is disposed between the support 18 and the spreading station D.

The strips 7*a*–7*f* of a group which is transferred by the pusher 37 through the channel 42 and to the spreading station D are engaged and attracted by holding means in the form of magnets 44*a* to 44*f* which are respectively mounted on slidable carriers 43*a* to 43*f*, one for each binding strip of a group. The carriers 43*a* to 43*f* are mounted on a guide means here shown as a tie rod 47 which is parallel to the axes of the binding strips 7*a* to 7*f* at the station D and can move the carriers 43*b* to 43*f* relative to each other so as to spread the binding strips 7*b* to 7*f* which adhere to the corresponding magnets 44*b* to 44*f* in a manner as shown in FIG. 1, i.e., in a direction away from the binding strip 7*a*. FIG. 2 further shows a rake-like transfer device 46 (hereinafter called rake for short) which is movable between the positions indicated by solid lines and phantom lines. When the pusher 37 is in the process of transferring a freshly separated group of binding strips 7*a* to 7*f* from the station C to the station D, the rake 46 is held in the phantom-line position of FIG. 2 so that it does not interfere with entry of the binding strips 7*a* to 7*f* into the station D. In the embodiment of FIG. 2, the rake 46 is pivotable between its solid-line and phantom-line positions.

The carriers 43*a* to 43*f* can be said to constitute an intermediate conveyor (denoted in FIG. 2 by the reference character 40) whose components 43*b* to 43*f* are caused to slide along and/or with the tie rod 47 so as to move the corresponding binding strips 7*b* to 7*f* away from each other and away from the binding strip 7*a* by moving in the axial direction of the strip 7*a*. The intermediate conveyor 40 is parallel to the conveyor 17, and the tie rod 47 extends and is reciprocable at right angles to the plane of FIG. 2. The arrangement is such that, in the absence of any obstacles in their respective paths, the carriers 43*b* to 43*f* share the axial movements of the tie rod 47, i.e., such tie rod constitutes a common means for moving the carriers 43*b*–43*f* axially of the binding strips 7*a*–7*f* at the spreading station D. However, if one of the carriers 43*b* to 43*f* (e.g., the carrier 43*b*) encounters an obstruction, it is arrested but the remaining carriers (i.e., the carriers 43*c* to 43*f*) continue to share the movement of the tie rod 47. The means for arresting the carriers 43*b* to 43*f* at preselected distances from the carrier 43*a* for the binding strip 7*a* comprises stops 48*b* to 48*f*, one for each of the movable carriers. A further stop 48*a* is provided to hold the carrier 43*a* against movement with the tie rod 47 and with the carriers 47*b* to 47*f*. The carriers 43*a* to 43*f* have staggered front faces which are aligned with the respective stops 48*a* to 48*f*, but do not interfere with movements of neighboring carriers to desired positions in response to axial movement of the tie rod 47. The front face of the first carrier 43*a* permanently abuts against the stop 48*a*, the front face of the carrier 43*b* is arrested by the respective stop 48*b* shortly after the corresponding binding strip 7*b* begins to move away from the binding strip 7*a* on the magnet 44*a* of the carrier 43*a*, the front face of the carrier 43*c* is arrested by the stop 48*c* shortly after the corresponding binding strip 7*c* advances beyond the binding strip 7*b* on the magnet 44*b* of the carrier 43*b*, and so forth.

The carriers 43*a* to 43*f* are preferably provided with annuli of spherical or otherwise configurated rolling elements (not shown) which surround and contact the periphery of the tie rod 47 and whose bias against the tie rod can be adjusted so that the person in charge can vary the force with which the carriers 43*a* to 43*f* are urged against the exterior of the tie rod 47, i.e., the force which must be overcome when a carrier is to be arrested and held against further movement with the tie rod 47 in a direction to spread the binding strips 7*a* to 7*f* of the corresponding group apart.

The stops 48*a* to 48*f* are mounted on a rod-shaped supporting element 49 which is installed in the frame of the apparatus, and each stop is adjustably secured to the supporting element 49 by a screw, bolt or an analogous fastener 49*a* so that the person in charge can rapidly change the distribution of the stops, as considered in the direction of the arrow 9 shown in FIG. 1.

When the tie rod 47 is moved back to its starting position, the carrier 43*b* is arrested by the carrier 43*a*, the carrier 43*c* is arrested by the carrier 43*b*, and so forth, so that the magnets 44*a*–44*f* are in optimum positions to attract the next group of six coaxial binding strips 7*a* to 7*f*. When the tie rod 47 commences its return stroke, its peripheral surface slides with reference to the stationary carrier 43*a*, such surface begins to slide with reference to the carrier 43*b* when the latter engages and is arrested by the carrier 43*a*, and so on.

In the next step, the rake 46 is pivoted from the phantom-line to the solid-line position of FIG. 2 so that its portion 46*a* is located behind the spread-apart binding strips 7*a* to 7*f* at the station D. That end portion of the rake 46 which is remote from the spreading station D is secured to a shaft 50 which is rotatable in a carriage 51 mounted on a guide rod 53 extending at right angles to the axis of the shaft 50 and at right angles to the axes of binding strips 7*a*–7*f* at the station D. The shaft 50 is pivotable back and forth in the directions indicated by a double-headed arrow 52 (e.g., by a suitable rotary electromagnet or by a gear train), and the carriage 51 is reciprocable in directions indicated by a double-headed arrow 54 under the action of a suitable motor, e.g., a rack and pinion drive or a fluid-operated double-acting cylinder and piston unit, not shown.

The rake 46 has an adjustable guide element 45 which can be positioned in such a way that it is immediately adjacent to or actually contacts the tip of prongs of the binding elements 7*a*–7*f* when the rake assumes the solid-line position of FIG. 2. The portion 46*a* of the rake 46 has a set of teeth 55 or analogous projections corresponding to the teeth 36 on the pusher 37 and serving to engage and guide the prongs of the spread-apart binding strips 7*a* to 7*f* during transfer from the station D to the station E. When the rake 46 performs an upward stroke to move the binding strips 7*a* to 7*f* from the station D to the station E, the binding strips slide along a stationary guide 56 whose left-hand side is coplanar or substantially coplanar with the exposed surfaces of magnets 44*a* to 44*f* at the station D. Upon arrival at the intermediate station E, the binding strips 7*a* to 7*f* are engaged and attracted by magnets 57 which are adjustably mounted on brackets 58 secured to a further conveyor 59, preferably an endless belt or band conveyor, which is movable in the recess of a support 61. Instead of providing adjustable connections between the magnets 57 and their brackets 58 (or in addition to such connections), it is possible to provide adjustable connections between the brackets 58 and the conveyor 59. The return reach or stretch of the conveyor 59 (namely, the stretch or reach which moves empty magnets 57 from the station F back to the station E) is not shown in FIG. 2. The means for intermittently driving the conveyor 59 may comprise a stepping motor or any other suitable device (such as a geneva movement) which can transport the conveyor 59 in stepwise fashion, namely, through increments corresponding to the distance between the intermediate stations E and F.

The purpose of the conveyor 59 is to transport groups of spread-apart binding strips 7*a* to 7*f* from the intermediate station E to the intermediate station F by moving the strips in the direction of their common axis and without changing the spacing between the neighboring strips. At the station F, the group of strips 7*a* to 7*f* is engaged and moved at right angles to the common axis of such strips by a system 62 which conveys the strips to the binding station G and which further serves to deform the strips 7*a* to 7*f* so that each thereof assumes the shape of a tube or the shape of a body which resembles a tube and ties the sheets of the respective stack 14 to each other by having its prongs extend through the adjacent perforations 16. The conveyor system 62 comprises two jaws 64' and 64'' which make an obtuse angle of slightly less than 180 degrees and are respectively reciprocable (toward and away from each other) in directions indicated by double-headed arrows 63' and 63''. The arrangement is such that the jaws 64' and 64'' reliably engage but need not necessarily deform the group of spread-apart binding strips 7*a* to 7*f* during transfer from the second intermediate station F to the binding station G, i.e., the engagement between the jaws and the binding strips is barely or just sufficient to ensure that the binding strips are transferred without any undesirable changes in orientation but that their shape remains at least substantially unchanged.

The station G further accommodates a supplying means or conveyor 66A in the form of a turret having a plurality of radially extending equidistant pairs of holders 66 which deliver pairs of aligned stacks 14 to the station G and into the range of the jaws 64', 64'', so that the jaws can insert the binding strips 7*a* to 7*f* and thereupon convert such strips into substantially tubular or cylindrical pronged binders 7*a'* to 7*f'*. A turret which is similar to that adapted to be used at the binding station G of FIG. 2 is disclosed in commonly owned U.S. Pat. No. 4,157,821 granted to me on June 12, 1979. The disclosure of this patent is incorporated herein by reference in lieu of a detailed description and illustration of the means for supplying stacks of sheets to the holders 66 of the conveyor 66A. The conveyor 66A is indexed at desired intervals so that two aligned stacks 14 are located at the binding station G not later than on arrival of the jaws 64', 64" (with six spaced-apart binding strips 7a to 7f therebetween) from the second intermediate station F.

The jaws 64' and 64" comprise substantially prismatic guide elements 67' and 67" having profiles 68' and 68" which can conform to those of the adjacent portions of binding strips 7a to 7f when such binding strips are held between and transported by the two jaws. The jaws 64' and 64" further carry propping members 69' and 69" which bear against the respective outermost sheets of the stacks 14 at the station G during closing of the strips 7a to 7f. The propping members 69' and 69" have edges which engage the respective outermost sheets in the region of the row of perforations 16. These propping members are movable into engagement with the outermost sheets against the opposition of springs 70' and 70", and their edges guide the prongs of the binding strips 7a to 7f during penetration into the registering perforations 16.

FIG. 3 shows portions of the jaws 64' and 64" without the guide elements 67', 67" and profiles 68', 68". The center line 71" of the jaw 64" intersects the common axis A' of the deformed binding strips or binders 7a' to 7f'. On the other hand, the center line 71' of the jaw 64' crosses in space with but does not intersect the axis A'. It is also within the purview of the invention to mount the jaw 64" in such a way that its center line 71" also merely crosses in space with but does not intersect the axis A'; the center lines 71' and 71" then extend at the opposite sides of the axis A' and intersect each other at a location other than the axis A'. The staggering of center line 71" and/or 71' with reference to the axis A' ensures that the end portions $P_1$ and $P_2$ (see also FIG. 1) of prongs of the binding strips 7a to 7f move past, rather than against, each other during conversion of such binding strips into binders 7a' to 7f'. This can be readily seen in FIG. 3; the end elevation of the binder which is shown therein resembles one winding of a true spiral rather than that of a helix. Such configuration is much less likely to prevent accidental removal of a sheet from a steno pad, exercise book, calendar or another stationary article wherein the sheets are held together by pronged binders.

The means for moving the jaws 64' and 64" between the solid-line positions and the phantom-line positions of FIG. 2 comprises a carriage CAR which is reciprocable in directions indicated by a double-headed arrow 72, e.g., by a double-acting fluid-operated cylinder and piston unit, not shown. Two displacing bars DB which flank the path of the jaws 64', 64" between the stations F and G can be moved by cams CA in several stages to change the distance between the jaws 64', 64", i.e., to shift the jaws in directions substantially at right angles to the direction of movement (arrow 72) of the jaws with the carriage CAR. The cams CA are driven by the prime mover of the production line which embodies the improved apparatus in such a way that the jaws 64', 64" move from the fully closed to the fully open positions during movement of the carriage CAR from the station G to the station F. At the station F, the displacing bars DB are caused to shift the jaws 64', 64" toward each other to the extent which is necessary to cause the profiles 68', 68" of the guide elements 67', 67" to engage the set of spread-apart binding strips 7a to 7f at the station F without, however, appreciably deforming the binding strips. The jaws 64' and 64" thereupon remain in such positions during movement of the carriage CAR back to the binding station G. On arrival at the station G, the displacing bars DB cause the jaws 64', 64" to move further toward each other and to thereby convert the substantially C-shaped binding strips 7a to 7f into substantially tubular (actually helical) binders 7a' to 7f'. Closing of the jaws 64' and 64" at the binding station G entails automatic penetration of the prongs of binding strips 7a to 7f into the neighboring perforations 16 of the two stacks 14 at the station G, i.e., of the stacks which are confined between those holders 66 of the conveyor 66A which are located at the station G. The arrangement is preferably such that the cams CA allow a slight opening of the jaws 64', 64" subsequent to initial closing, and that the displacing bars DB thereupon again shift the jaws 64' and 64" to their fully closed positions. Such repeated closing of the jaws 64' and 64" (preferably in rapid sequence) allows for renewed orientation of the binding strips 7a to 7f prior to final closing which then ensures that the binding strips 7a to 7f are closed exactly to the desired extent, i.e., that the configuration of the binders 7a' to 7f' matches the desired or optimum configuration. If desired, opening and closing of the once closed jaws 64' and 64" can be repeated more than once.

The apparatus which is shown in FIGS. 1 and 2 can be readily converted for the making of stationary articles with one-piece binders, i.e., with binders whose length equals or approximates the length of a row of perforations 16 in a stack 14 of overlapping sheets. A portion of such modified apparatus is shown schematically in FIG. 4. The severing device at the station C then comprises only two severing tools which separate from the leader of the strand 104 a pair of coaxial binding strips 707a, 707b whenever the strand 104 comes to a halt. The direction in which the strand 104 is intermittently advanced from the second bending station B (not shown in FIG. 4) is indicated by the arrow 106. The length of each of the two binding strips 707a, 707b approximates the length of a row of perforations in a stack of sheets (not shown in FIG. 4). The binding station of the apparatus which includes the structure of FIG. 4 is assumed to receive two stacks of sheets at a time. The two freshly severed binding strips 707a and 707b are moved sideways in the direction of arrow 108 to a spreading station D where the binding strip 707b is separated from the binding strip 707a by moving it axially in the direction of arrow 109. The thus spread-apart binding strips 707a, 707b are then moved sideways (arrow 111) to the station E (not shown), from the station E to the station F (not shown) by moving the binding strips 707a, 707b axially, and from the station F to the station G (not shown) by moving the binding strips 707a, 707b sideways. In the apparatus of FIG. 4, the six magnet carriers 43a to 43f are replaced with two relatively long magnet carriers, one for each of the two binding strips 707a, 707b in a group. The stops 48a to 48f of FIG. 2 are replaced with two stops one of which prevents the carrier for the binding strip 707a from moving in the direction of common axis of the binding strips 707a, 707b and the other of which arrests the second carrier (for the binding strip 707b) when the binding strip 707b assumes the position corresponding to that shown at the spreading station D of FIG. 4.

The apparatus of FIGS. 1 and 2 can be utilized for the making of stationary articles with so-called skip binders at the frequency at which a conventional apparatus produces stationery articles with one-piece pronged binders. Alternatively, and as actually shown in FIGS. 1 and 2, the apparatus can be used to produce, per unit of time, twice as many articles with skip binders as a conventional apparatus for the making of articles with one-piece binders. If the apparatus of FIGS. 1 and 2 is to be converted for the making of one article with a skip binder at a time, the conveyor 66A is designed to deliver a single stack 14 at each of successive timely spaced intervals and the remainder of the apparatus is designed to deliver to the binding station G a total of n (instead of m×n) discrete strips at the intervals at which the binding station G receives discrete stacks 14 from the conveyor 66A. In the embodiment of the apparatus which is shown in FIGS. 1 and 2, m equals two and n equals three, i.e., m is a whole number which is smaller than n. The intermediate conveyor 40 is designed to move m×n−1 discrete strips (*7b* to *7f*) axially and away from each other as well as from the remaining strip (*7a*) in such a way that the distance which is covered by the strip *7c* exceeds the distance covered by the strip *7b*, that the distance which is covered by the strip *7d* exceeds the distance covered by the strip *7c*, and so forth.

In the apparatus of FIG. 4, the number (n) of discrete strips which are separated from the strand 104 at the severing station C equals the number of stacks of overlapping sheets which are delivered or supplied to the binding station at the same frequency at which the severing device separates groups of two strips (*707a*, *707b*) each from the leader of the strand 104 at the station C.

Figure 5:
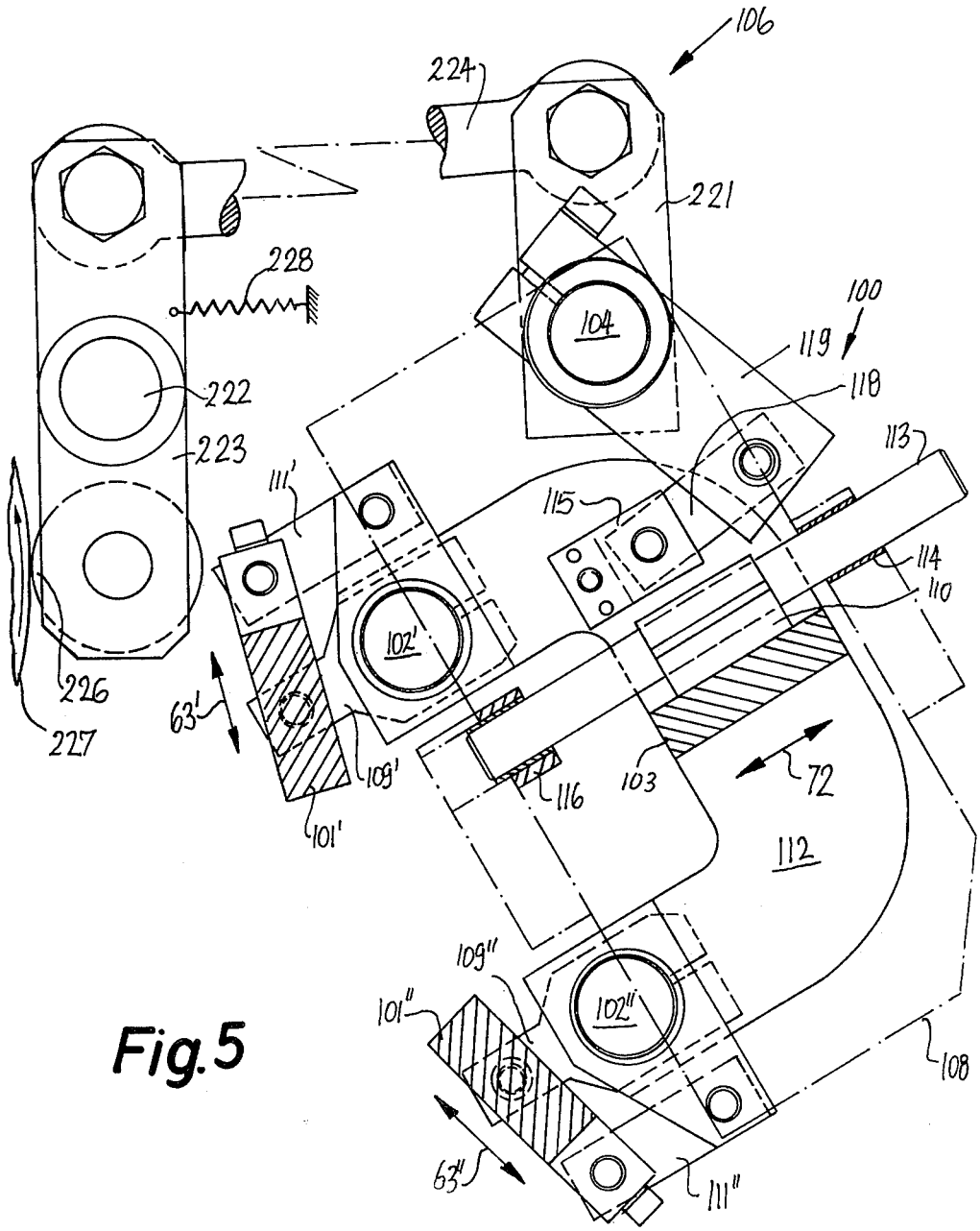
FIG. 5 is an enlarged partly sectional view of a portion of means for transmitting motion to the aforementioned strip conveying, inserting and closing devices.
Figure 6:
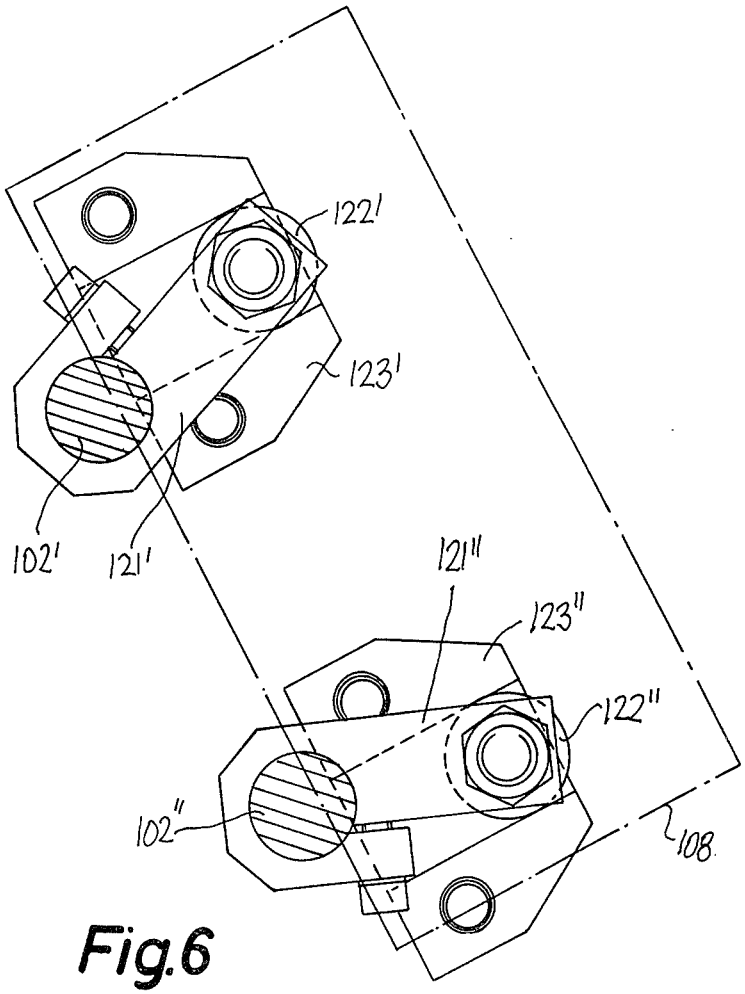
FIG. 6 is a similar view of the motion transmitting means in a plane which is parallel to the plane of FIG. 5.
Figure 7:
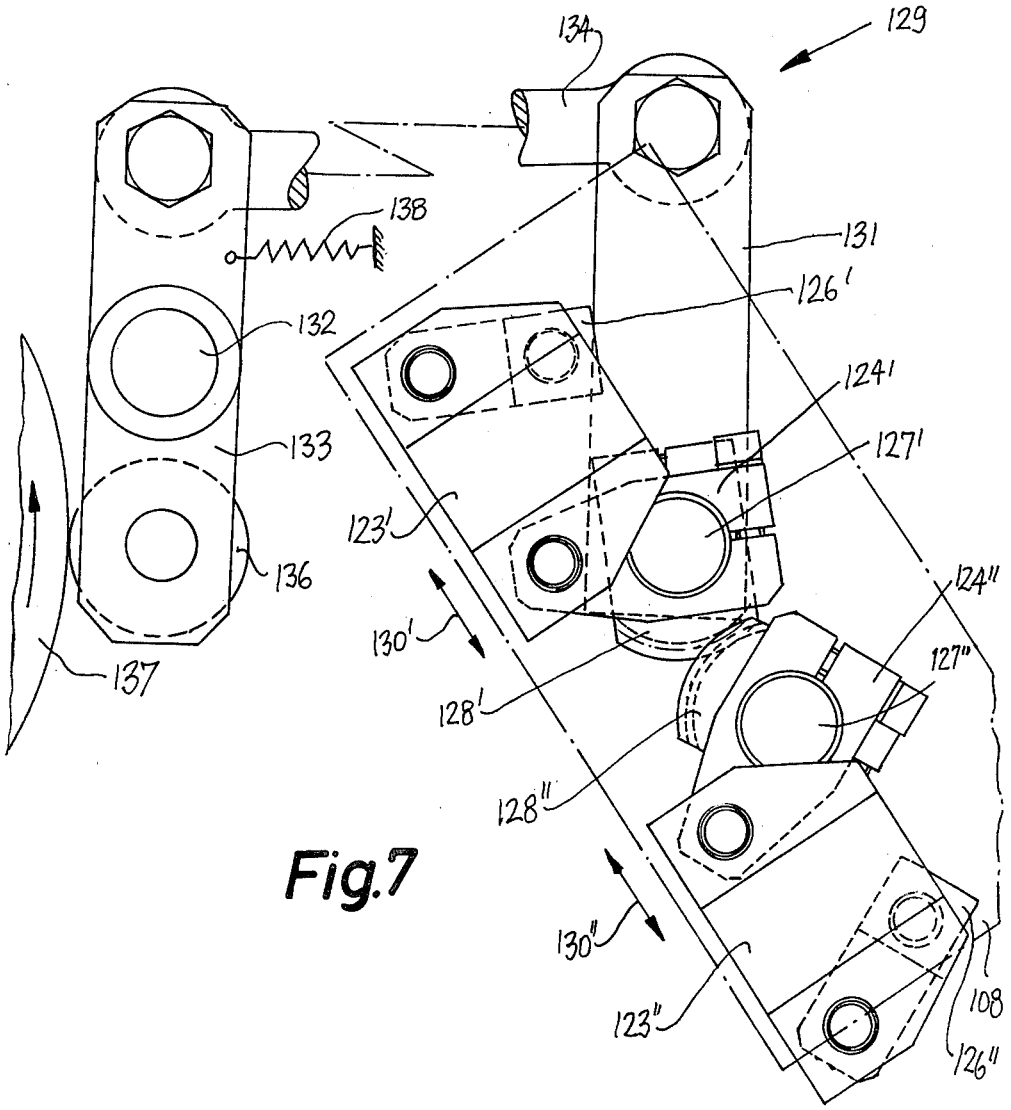
FIG. 7 is a similar view of the motion transmitting means in a plane which is parallel to the planes of FIGS. 5 and 6.

FIGS. 5 to 7 illustrate in greater detail one form of a means for supporting and moving the jaws 64' and 64''. These jaws are not shown in FIGS. 5 to 7. The jaw 64' is mounted on a strip-shaped holder 101', and the jaw 64'' is mounted on a similar holder 101'' (note FIG. 5). The holders 101' and 101'' are movable in directions which are indicated by the double-headed arrows 63' and 63''. The jaw supporting and moving means further comprises a carrier 103, three shafts 102', 102'' and 104, a driving unit or drive means 106 which is connected with the shaft 104 and numerous additional components all of which are disposed in pairs, namely, mirror symmetrically with reference to a plane located midway between the two side faces of the jaws 64' and 64''. The parts which are shown in FIGS. 5, 6 and 7 are disposed immediately behind one another, i.e., the parts which are shown in FIG. 6 are located behind the parts shown in FIG. 5 and the parts shown in FIG. 7 are located behind the parts shown in FIG. 6. The parts which are shown in FIG. 7 are located in front of a bearing plate 108 (indicated in each of FIGS. 5 to 7 by phantom lines) which is secured to or forms part of the frame of the apparatus or production line embodying the improved apparatus. The parts which are shown in FIGS. 5 to 7 are located behind the jaws 64', 64'' and will be described in detail hereinafter. Such parts are mirror symmetrical to the parts which are located in front of the two jaws, i.e., in front of the holders 101', 101'' shown in FIG. 5.

The holders 101' and 101'' are respectively mounted on pairs of links 109', 111' and 109'', 111''. The links 109' and 109'' are respectively affixed to and share the angular movements of the shafts 102' and 102''. The links 111' and 111'' are articulately connected with a yoke 112 which rotatably mounts the shafts 102' and 102''. The aforementioned carrier 103 connects the yoke 112 of FIG. 5 with the other yoke, namely, with the yoke which is located in front of the structure shown in FIG. 5. Such second yoke is located in front of the plane of FIG. 5 and the jaws 64', 64'' are disposed in the space between the two yokes. The carrier 103 and the two yokes 112 together constitute a carriage 100 corresponding substantially to the carriage CAR shown schematically in FIG. 2.

The carrier 103 supports several guide rods 113 (only one shown in FIG. 5) which are secured thereto by grippers 110 or analogous clamping devices. The guide rods 113 are journalled in additional guide means here shown as crossheads or traverses 114, 116 secured to the bearing plate 108. Thus, the driving unit 106 can move the carrier 103, the two yokes 112, the shaft 102', 102'' and the holder 101', 101'' in directions which are indicated by the double-headed arrow 72, i.e., lengthwise of the guide rolls 113 and substantially at right angles to the directions indicated by arrows 63', 63''. Each yoke 112 is connected with a forked bearing member 115 for a link 118 which articulately connects the bearing member 115 (and hence the respective yoke 112) with a lever 119 which is non-rotatably secured to the shaft 104.

The driving unit 106 comprises a lever 221 which is non-rotatably affixed to the shaft 104 and a two-armed lever 223 which is rotatable about the axis of a stationary shaft 222. One arm of the lever 223 is connected with the lever 221 by a connecting rod 224, and the other arm of the lever 223 carries a roller follower 226. The driving unit 106 further comprises a disc-shaped cam 227 whose peripheral surface is tracked by the roller follower 226 and which receives motion from the main prime mover of the production line including the improved apparatus. A coil spring 228 or an analogous biasing device is provided to act on the one arm of the lever 223 in order to maintain the roller follower 226 in engagement with the cam 227.

As shown in FIG. 6, the shafts 102', 102'' are non-rotatably connected with levers 121', 121'' which are located behind the yoke 112 of FIG. 5, i.e., they are more distant from the jaws 64' and 64''. The free end portions of the levers 121', 121'' respectively carry roller followers 122', 122'' extending into slotted guides 123', 123''. As shown in FIG. 7, the slotted guides 123', 123'' are respectively mounted on pairs of links 124', 126' and 124'', 126''. The links 124' and 124'' are non-rotatably secured to shafts 127' and 127'' which are journalled in the bearing plate 108. On the other hand, the links 126' and 126'' are pivotably mounted on the bearing plate 108. The shafts 127' and 127'' are non-rotatably connected with mating gear segments 128' and 128'' so that, when the shaft 127' is rotated by a driving unit 129, the shaft 127'' is caused to rotate through the same angle but in the opposite direction. Such angular movements of the shafts 127' and 127'' cause the slotted guides 123' and 123'' as well as the levers 124' and 124'' to move in the directions which are respectively indicated by double-headed arrows 130' and 130'' shown in FIG. 7. The guides 123' and 123'' thereby cause the roller followers 122' and 122'' to pivot the corresponding levers 121' and 121'' with the result that the shafts 102' and 102'' rotate in opposite directions and cause the links 109', 109'', to shift the holders 101', 101'' for the jaws 64' and 64'' toward or away from each other as indicated by the arrows 63' and 63''. In other words, the jaws 64' and 64'' are shifted to their open or closed positions, depending on the direction of rotation of the shafts 102' and 102''.

The slotted guides 123' and 123'' enable the carrier 103, the yokes 112 and the holders 101', 101'' to move in the directions which are indicated by the double-headed arrow 72, i.e., between the second intermediate station F and the binding station G, without interrupting the transmission of motion from the driving unit 129 to the jaws 64' and 64", i.e., these jaws can open and close in each end position and/or in each intermediate position of the carriage 100.

The driving unit 129 of FIG. 7 constitutes one of two mirror symmetrical driving units and comprises a lever 131 which is rigidly connected to the shaft 127' and a two-armed lever 133 which is turnable about the axis of a fixed shaft 132. One arm of the lever 133 is connected with the lever 131 by a connecting rod 134, and the other arm of the lever 133 is provided with a roller follower 136 tracking the peripheral surface of a rotary disc-shaped cam 137 which receives motion from the main prime mover of the production line. A spring 138 is provided to urge the roller follower 136 against the cam 137.

The configuration of peripheral surfaces of the cams 227 and 137 is such that the jaws 64' and 64" are caused to perform the aforedescribed movements with reference to each other. Thus, the jaws open not later than on arrival at the station F, they close sufficiently to adequately engage the group of spread-apart binding strips *7a* to *7f* to the station F, and they close once or more than once on arrival at the station G to thereby convert the binding strips *7a* to *7f* into finished binders *7a'* to *7f'*. The cams 227 and 137 can be said to perform the functions of the schematically indicated cams CA shown in FIG. 2, and the parts which transmit motion from such cams to the jaws 64', 64" can be said to be analogous to the schematically shown displacing bars DB of FIG. 2.

The slotted guides 123', 123" remain parallel to each other at all times, i.e., the paths which they define for the respective roller followers 122', 122" are parallel to each other. This is ensured by the aforediscussed mounting of the guides 123' and 123", i.e., each of these guides is mounted on a parallel mechanism whose components 124', 126' and 124", 126" are mounted in the frame, namely, on the bearing plate 108.

It will be noted that the jaws 64' and 64" perform a number of important and desirable functions. Thus, in addition to the function of inserting the groups of binding strips (such as *7a* to *7f*) into the perforations of m stacks 14 at the binding station G and of closing the thus inserted binding strips, the jaws 64' and 64" form part of a conveyor system which is used to deliver or transfer successive groups of spaced-apart binding strips to the binding station G. In the embodiment of FIGS. 1 and 2, the jaws 64' and 64" accept groups of binding strips at the station F and deliver such groups to the binding station G. In addition, the jaws 64' and 64" perform the function of closing the binding strips to a desired extent, i.e., so that each binding strip is converted into a truly cylindrical binder or into a binder having a configuration corresponding to that shown in FIG. 3.

The feature of employing a pair of jaws as component parts of a conveyor system which transports one or more binding strips to the binding station can be used with equal advantage in heretofore known apparatus wherein only one binding strip is inserted into the perforations of a single stack of sheets at the binding station. In the embodiment of FIGS. 1 and 2, the jaws 64' and 64" accept the binding strips from the conveyor 59 which transports the binding strips to the station F, i.e., toward but short of the binding station G. An important advantage of a conveyor system with a set of jaws which can deform the binding strip or strips is that the binding strips are much less likely to be improperly oriented at the binding station. Moreover, such conveyor system contributes to simplicity of the apparatus because it obviates the need for a host of additional or auxiliary components which must be utilized in many conventional apparatus in order to ensure accurate positioning of a binding strip, which was delivered by a conveyor all the way to the binding station, in such a way that the binding strip is properly positioned with respect to the jaws of the inserting and closing device as well as with reference to the perforations of the stack of sheets at the binding station.

The feature that the jaws 64', 64" form part of a system for conveying discrete binding strips or groups of binding strips to the binding station obviates the need for mechanisms of the type disclosed in the aforementioned U.S. Pat. No. 3,883,916 to Adams et al. wherein the means for transferring binding strips to the binding station comprises a pivotable lever with magnet means and such lever is provided in addition to the device which closes the binding strips at the binding station. The system including the jaws 64', 64" not only contributes to simplicity of the improved apparatus but also enhances its reliability because the binding strips are necessarily oriented and held in optimum positions preparatory to connection with the stacks of sheets at the binding station. Thus, once a binding strip or a group of coaxial binding strips is properly engaged by the profiled guide elements 67' and 67" of the two jaws, such binding strip or strips are automatically caused to assume optimum positions with reference to one or more stacks of sheets upon arrival of the binding strip or strips at the binding station.

The guide elements 67', 67" need not conform only to the general outlines of the adjacent portions of binding strips between the jaws 64' and 64" but can also include grooves and ribs or analogous protuberances to even more reliably engage the C-shaped prongs of the binding strips between the jaws.

Complete closing of binding strips at the binding station is desirable and advantageous because this reduces or completely eliminates the likelihood of unintentional removal of certain sheets from the stationery article which is obtained upon completion of conversion of one or more binding strips into tubular binders whose prongs extend through the perforations of stacked sheets. As mentioned above, complete closing of binding strips is enhanced by the provision of drive means which can repeatedly move the jaws 64', 64" toward each other, i.e., which can repeatedly move the jaws to their closed positions, preferably in rapid sequence. During conversion into tubular binders, portions of the binding strips slide along the guide elements 67' and 67" of the jaws 64' and 64". Such sliding movements can take place after the jaws overcome a certain amount of friction which develops between the profiles 68', 68" and the adjacent portions of prongs forming part of the binding strips. Such friction opposes complete closing of the binding strips. It has been found that repeated movements of jaws 64' and 64" to closed positions are much more likely to eliminate the negative effects of friction upon complete closing of the binding strips, i.e., upon conversion of binding strips into binders having an optimum shape for retention of sheets against separation from other sheets of a finished stationery article. The second, third and further closings of the jaws need not be preceded by a movement of the jaws to fully open positions, i.e., it suffices if the jaws are moved slightly apart subsequent to first movement to closed positions and are thereupon returned to such closed positions to effect a predictable conversion of one or more binding strips into one or more binders of desirable size and shape. As shown in FIG. 7, the means for closing the jaws 64', 64" comprises the driving unit or drive means 129 whose cam 137 transmits motion to the jaws by way of roller follower means 136, slotted guides 123', 123" and roller followers 122', 122".

In many conventional apparatus which convert pronged binding strips into tubular binders, the jaws have substantially semicylindrical concave surfaces which engage the binding strips during conversion of such strips into binders. When the jaws are closed, their concave surfaces together form a substantially complete cylindrical surface which is complementary to the desired external surface of the finished binder. A drawback of such jaws is that the friction between their concave surfaces and the adjacent portions of binding strips is very pronounced during movement of the jaws to their closed positions. In accordance with the invention, the jaws 64', 64" carry substantially prismatic guide elements 67', 67" whose profiles 68' and 68" need not be in full contact with the adjacent portions of the binding strips while the binding strips are being converted into tubular binders. This results in greatly reduced friction between the binding strips and the jaws during movement of the jaws to their closed positions, i.e., during insertion of the prongs of binding strips into the adjacent perforations 16 and during closing of the binding strips so that each thereof constitutes a tubular or cylindrical binder. It has been found that such pronounced reduction of contact between the jaws 64', 64" and the binding strips therebetween during closing of the jaws does not adversely affect the shape and retaining action of the finished binders.

The common plane of the paths along which the jaws 64', 64" respectively move in directions indicated by the arrows 63' and 63" is preferably normal substantially normal to the axis or axes of the binding strip or strips between the guide elements 67' and 67". Furthermore, the just mentioned paths for the jaws 64' and 64" preferably make a relatively large obtuse angle which can be only slightly less than 180°. This has been found to contribute to conversion of binding strips into binders of highly satisfactory shape, namely, into binders whose prongs are converted into rings having a uniform curvature and an at least substantially circular shape. Thus, there is no need to pivot the jaws 64', 64" during conversion of binding strips into circumferentially complete binders. This greatly reduces the cost of the mechanism which is used to impart movements to and to guide the jaws at the binding station. Reference may be had to U.S. Pat. No. 3,451,081 granted June 24, 1969 to Liouville. This patent discloses a conventional system wherein each of the two jaws must perform a complex composite translatory and pivotal movement during conversion of a binding strip into a tubular binder.

As mentioned above, the jaws 64', 64" render it possible to close the binding strips in a manner as shown in FIG. 3 so that the end portions $P_1$ and $P_2$ of the prongs slide along and beyond each other. This is achieved by the simple expendient of ensuring that at least one of the two center lines 71' and 71" crosses in space with the common axis A' of the binding strips between the two jaws. Otherwise stated, the center lines 71' and 71" intersect each other at a location other than on the axis A'. The center lines 71' and 71" are normal or at least substantially normal to the axis A'.

Figure 8:
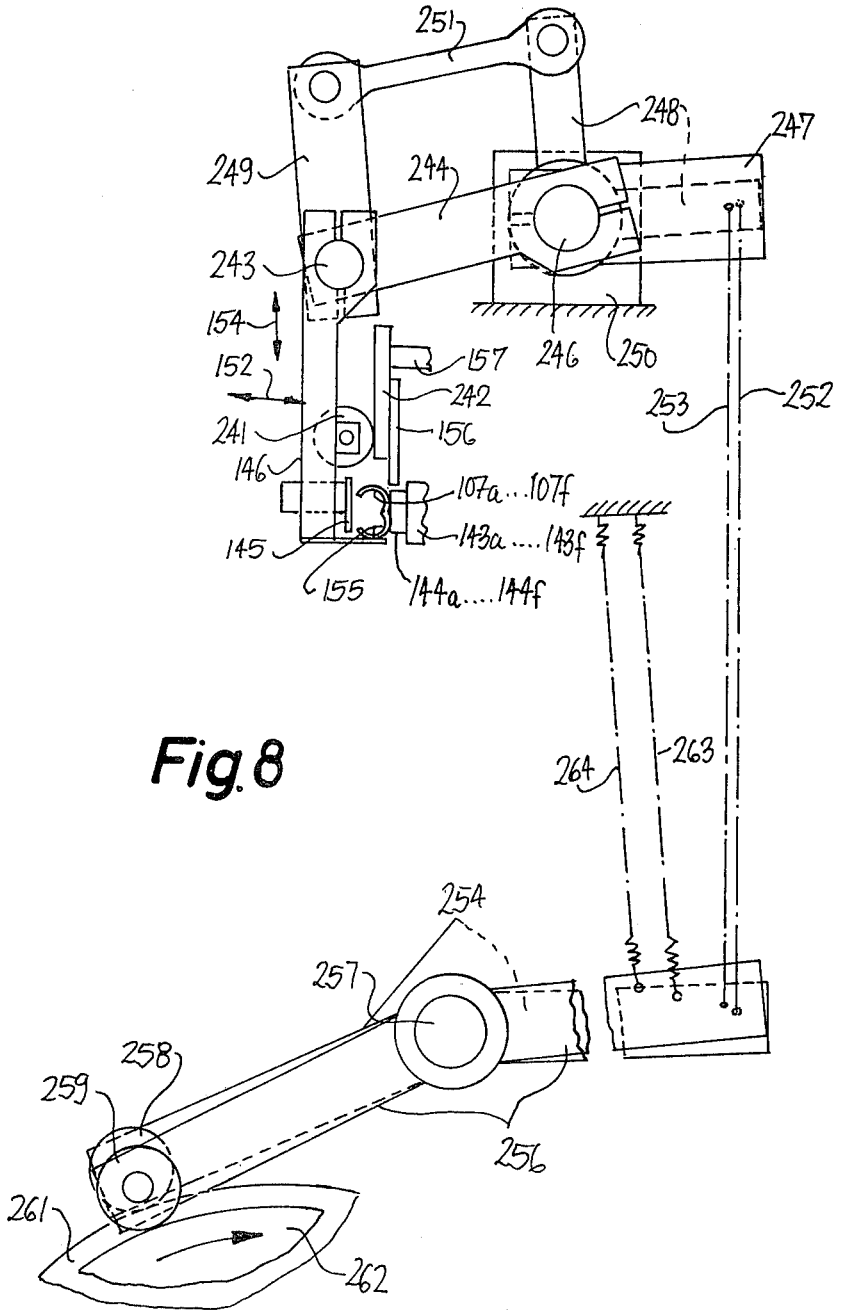
FIG. 8 is an enlarged partly diagrammatic view of a rake-like device which serves to remove groups of freshly severed binding strips from the severing station in the predetermined portion of the path for the strand of coherent binding strips.

FIG. 8 illustrates the details of a presently preferred unit which imparts movements to a rake 146 corresponding to the rake 46 of FIG. 2. FIG. 8 further shows the carriers **143*a* to 143*f* with magnets 144*a* to 144*f*, a group of binding strips 107*a* to 107*f* and several other parts which are identical with or clearly analogous to the corresponding parts of the apparatus shown in FIG. 2 and are denoted by similar reference characters plus 100. Thus, the character 156 denotes a stationary guide between the stations D and E, the part 157** denotes a magnet at the station E, and so forth.

The rake 146 of FIG. 8 is provided with a roller follower 241 which rolls along a stationary linear cam 242 during movement of the rake in an upward direction, as viewed in FIG. 8, i.e., during transfer of a group of binding strips **107*a* to 107*f* from the spreading station D to the first intermediate station E. The cam 242 is located behind the stationary guide 156, as viewed in FIG. 8**.

The upper end portion of the rake 146, as viewed in FIG. 8, is non-rotatably secured to a shaft 243 which is rotatably journalled in a lever 244. The lever 244 is non-rotatably secured to a shaft 246 which is further non-rotatably connected with a lever 247. A bell crank lever 248 is rotatably mounted on the shaft 246 which is rotatable in a bearing block 250. The bell crank lever 248, a lever 249 which is non-rotatably secured to the shaft 243 and a link 251 together constitute a parallel mechanism.

The phantom lines 252 and 253 denote two connecting rods the first of which connects the lever 247 with one arm of a first two-armed lever 254. The rod 253 connects the bell crank lever 248 with one arm of a second two-armed lever 256. The levers 254 and 256 are pivotable about the axis of a common stationary shaft 257 and their left-hand arms, as viewed in FIG. 8, respectively carry roller followers 258 and 259 tracking the peripheral surfaces of two driven disc-shaped cams 261, 262. The cams 261 and 262 receive torque from the main prime mover of the production line. Springs 263 and 264 are provided to respectively urge the roller followers 258 and 259 against the associated cams 261 and 262; these springs are attached to the frame and to the right-hand arms of the levers 254, 256, as viewed in FIG. 8.

In order to move the rake 146 upwardly, as viewed in FIG. 8, i.e., to transfer a group of binding strips **107*a* to 107*f* from the station D to the station E, the cam 261 causes the roller follower 258 to pivot the lever 254 in a clockwise direction whereby the connecting rod 252 pivots the lever 247 clockwise so that the lever 244 moves the shaft 243 upwardly. At such time, the cam 262 allows the spring 264 to maintain the lever 256 in an angular position in which the connecting rod 253 causes the lever 248, the link 251, the lever 249 and the shaft 243 to urge the rake 146 in a counterclockwise direction, as viewed in FIG. 8, so that the roller follower 241 bears against the linear cam 242. When the rake 146 reaches the upper end position (i.e., when the group of binding strips 107*a* to 107*f* is transferred to the station E), the cam 262 causes the roller follower 259 to pivot the lever 256 against the opposition of the spring 264 so that the rake 146 is pivoted in a clockwise direction (about the axis of the shaft 243). During the next stage of its rotation, the cam 261 enables the spring 263 to move the rake 146** downwardly and, at the same time, the cam 262 ensures that the angular position of the lever 256 with reference to the lever 254 remains unchanged (i.e., the cams 261, 262 have portions of identical configuration which are tracked by the roller followers 258, 259 during movement of the rake 146 back to its lower end position). This means that the angular movements of the levers 254, 247 and rod 252 receiving motion from the cam 261 are synchronized with those of the levers 256, 248 and rod 253 receiving motion from the cam 262. Since the parts 244, 248, 249 and 251 constitute a parallel mechanism, the rake 146 remains in a position corresponding to the phantom-line position of the rake 46 of FIG. 2, i.e., the roller follower 241 is remote from the fixed cam 242 while the rake moves downwardly toward the station D. When the rake 146 reaches its lower end position under the action of the cam 261, the cam 262 causes the parts which receive motion therefrom to pivot the rake in a counterclockwise direction, as viewed in FIG. 8, so that the rake is ready to engage and entrain the next group of binding strips 107*a* to 107*f*, i.e., to transport such binding strips from the spreading station D to the first intermediate station E.

FIGS. 9 and 10 illustrate the details of one of several slidable carriers 343 which can be utilized in lieu of the carriers 43*a* to 43*f* shown in FIG. 2. The carrier 343 of FIGS. 9 and 10 is mounted on a spherical sleeve bearing 301 which is reciprocable along a fixed guide rod 302. A recess 304 of the carrier 343 is closed by a removable cover 303 and confines two plates 306, 307 consisting of Teflon or a similar material. The plates 306, 307 can be said to constitute two brake shoes and flank a portion of an elongated flexible element here shown as a toothed belt conveyor 308 which receives motion from the main prime mover of the production line and is movable back and forth in directions indicated by a double-headed arrow 309. This conveyor constitutes a common means for moving at least some of the carriers 343 at the spreading station in the axial direction of discrete binding strips at such station. The position of the plate or shoe 307 with reference to the plate or shoe 306 is adjustable by a screw 311 which mates with the cover 303 and can vary the force with which the plates 306, 307 bear against the respective sides of the conveyor 308. A pin or stud 312 of the carrier 343 cooperates with a pin-shaped stop 313 which is mounted in an L-shaped bracket 314. By locating the pins 312 of neighboring carriers 343 in different positions (as indicated in FIG. 9 by phantom lines), and by placing the stops 313 on the brackets 314 in the path of the respective pins 312, the conveyor 308 can move the carriers 343 through different distances from their starting positions in which the neighboring carriers are adjacent to each other at the spreading station D preparatory to movement of the binding strips 7*a* to 7*f* or 107*a* to 107*f* away from each other. The conveyor 308 is connected with all of the carriers 343. The bracket 314 of FIG. 9 and its stop 313 correspond to one of the stops 48*a* to 48*f* shown in FIG. 2. The conveyor 308 can be said to constitute a functional equivalent of the reciprocable tie rod 47 which is shown in FIG. 2. The conveyor 308 slides between the plates 306, 307 of the respective carriers 343 when the associated stops 313 prevent further movements of the respective carriers 343 in a direction to shift the corresponding binding strips away from the neighboring binding strip or strips.

Each carrier 343 is provided with a holder 316 for a magnet 344 corresponding to one of the magnets 44*a* to 44*f* shown in FIG. 2. Thus, each of the magnets 344 can temporarily attract a binding strip at the station D, namely, during movement of some or all of the binding strips of a group of binding strips axially of and away from each other.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art, and therefore, such adaptations should and are intended to be comprehended within the meaning and range of equivalence of the appended claims.

I claim:

1. A system for conveying C-shaped binding strips from a conveyor to a binding station at which the strips are inserted into the perforations of stacked sheets, comprising a pair of jaws; means for moving said jaws between said conveyor and said station; and means for shifting said jaws relative to each other so that said jaws can engage a binding strip in the region of said conveyor, deliver the strip from said conveyor to said station, and insert the strip into the perforations of sheets at said station, said shifting means including means defining paths for said jaws which make an oblique angle, and said paths being located in a plane which is at least substantially normal to the axis of a binding strip between said jaws.

2. A method of binding marginally perforated stacks of sheets with pronged binding strips comprising the steps of:

(a) advancing a strand of coherent pronged binding strips having respective axes along a predetermined path;

(b) supplying marginally perforated stacks of sheets to a binding station;

(c) substantially simultaneously severing at least two binding strips from the strand in a predetermined portion of said path to obtain a group of discrete strips;

(d) transferring the group of discrete strips from said path to said binding station as a unit, including moving the strips of the group transversely of their axes and spreading the strips of the group in the axial direction of the strips; and (e) introducing the spread strips into the perforations of at least one stack at said binding station.

3. The method of claim 2, wherein said advancing step includes moving the strand stepwise at timely spaced intervals and said severing step includes separating at least two discrete strips from the strand during each period of dwell of the strand in said path.

4. The method of claim 2, wherein said supplying step includes delivering to said station at least two stacks of sheets in such orientation that the perforations of sheets at said station form a single row.

5. The method of claim 3, wherein said supplying step includes conveying to said station sets of at least two stacks at said timely spaced intervals.

6. The method of claim 3, wherein said supplying step includes delivering to said station m stacks of sheets at said timely spaced intervals and each of said groups comprises $m \times n$ discrete strips so that each stack at said station is connected with n spaced-apart binding strips.

7. The method of claim 6, wherein n is a whole number exceeding m.

8. The method of claim 7, wherein m equals two and n equals three.

9. The method of claim 2, wherein said transferring step further includes moving the strips of the group substantially axially as a unit intermediate said portion of said path and said binding station.

10. The method of claim 2, wherein said transferring step includes (A) moving the strips of the group transversely of their axes away from said portion of said path, (B) spreading the strips of the group, (C) moving the spread strips transversely of their axes, (D) moving the spread strips substantially axially, and (E) moving the spread strips transversely of their axes to said binding station.

11. The method of claim 2, wherein the group has n discrete strips and said spreading step includes moving n−1 strips of the group substantially axially and away from each other through different distances.

12. The method of claim 2, wherein the strand is advanced in axial direction of the strips.

13. The method of claim 2, wherein said spreading step comprises moving at least one strip of the group away from a neighboring strip of the group substantially axially.

14. The method of claim 2, comprising the step of closing the strips after said introducing step.

15. The method of claim 2, wherein the strips are substantially C-shaped.

16. The method of claim 2, wherein the strips of the group are moved substantially normal to their axes during said transferring step.

17. The method of claim 2, wherein said supplying, severing, transferring and introducing steps are repeated at intervals.

18. The method of claim 2, wherein said severing step is performed in such a manner that the strips of the group are substantially coaxial upon completion of said severing step.

19. Apparatus for binding the marginally perforated sheets of stacks of superimposed sheets by pronged C-shaped binding strips, comprising a source of coherent binding strips; means for advancing a strand of coherent strips from said source along a predetermined path; a severing device adjacent to said path and comprising a plurality of tools arranged to separate groups of coaxial binding strips from said strand at timely spaced intervals; means for removing successive groups of binding strips from said path in a direction substantially at right angles to the axes of the binding strips; means for spreading the strips of successive groups in the axial direction of the strips, said spreading means including an intermediate conveyor having discrete carriers for the binding strips of a group, and means for moving at least some of said carriers through different distances in the axial direction of binding strips in a group supported by said carriers; means defining a binding station for stacks of superimposed sheets; and means for transferring groups of spread-apart strips from said spreading means to said binding station.

20. The apparatus of claim 19, wherein said binding station is arranged to accommodate n stacks and said intermediate conveyor comprises at least n−1 movable carriers, said severing device comprising n tools.

21. The apparatus of claim 19, wherein said binding station is arranged to accommodate m×n stacks and said intermediate conveyor comprises at least m×n−1 movable carriers, said severing device comprising m×n tools.

22. The apparatus of claim 19, wherein the binding strips contain magnetizable material and said carriers comprise magnets arranged to attract the binding strips of successive groups in the course of the spreading operation.

23. The apparatus of claim 19, wherein said intermediate conveyor further comprises guide means for said carriers, at least some of said carriers being movable lengthwise of said guide means in the axial direction of a group of binding strips which are supported by said carriers.

24. The apparatus of claim 19, wherein said intermediate conveyor comprises common means for moving at least some of said carriers in the axial direction of binding strips which are supported by said carriers.

25. The apparatus of claim 24, wherein said common means comprises a reciprocable elongated flexible element and wherein at least some of said carriers are movable lengthwise of said flexible element.

26. The apparatus of claim 25, wherein said flexible element is a belt.

27. The apparatus of claim 24, wherein said spreading means further comprises a plurality of stops, one for each of said movable carriers and each arranged to arrest the respective carrier in a predetermined position upon movement of such carrier in the axial direction of binding strips of a group of strips which are supported by said carriers.

28. The apparatus of claim 24, further comprising means for adjustably securing said carriers to said common moving means so as to allow for variations in the magnitude of force with which said moving means entrains said some carriers in the axial direction of binding strips of a group of strips which are supported by said carriers.

29. A system for conveying C-shaped binding strips from a conveyor to a binding station at which the strips are inserted into the perforations of stacked sheets, comprising a pair of jaws; means for moving said jaws between said conveyor and said station; and means for shifting said jaws relative to each other so that said jaws can engage a binding strip in the region of said conveyor, deliver the strip from said conveyor to said station, and insert the strip into the perforations of sheets at said station, said shifting means including drive means for moving said jaws to a plurality of positions with reference to each other, and said drive means comprising a movable cam, first follower means operatively connected with said jaws and arranged to track said cam, a slotted guide for each of said jaws movable by said first follower means, and second follower means cooperating with said slotted guides and connected with the respective jaws to move said jaws relative to each other in response to movement of said guides under the action of said first follower means.

30. A system for conveying C-shaped binding strips from a conveyor to a binding station at which the strips are inserted into the perforations of stacked sheets, comprising a pair of jaws; means for moving said jaws in first directions between said conveyor and said station, said moving means including a carriage for said jaws, and guide means for confining said carriage to translatory back-and-forth movements in said first directions; and means for shifting said jaws relative to each other so that said jaws can engage a binding strip in the region of said conveyor, deliver the strip from said conveyor to said station, and insert the strip into the perforations of sheets at said station, said shifting means comprising means for moving said jaws relative to said carriage in second directions substantially at right angles to said first directions, and said means for moving said jaws in said second directions including lever means pivotally mounted on said carriage and connected with said jaws, follower means provided on said lever means, and means for pivoting said lever means by way of said follower means.

31. The system of claim 30, wherein said pivoting means comprises slotted guide means for said follower means.

32. The system of claim 30, wherein said means for moving said jaws in said second directions further comprises means for moving said pivoting means to thereby pivot said lever means through the medium of the respective follower means.

33. The system of claim 32, wherein said means for moving said pivoting means comprises a pair of parallel mechanisms, one for each of said jaws.

34. Apparatus for binding marginally perforated stacks of sheets with pronged binding strips comprising:

(a) a binding station for marginally perforated stacks of sheets;

(b) a source of coherent pronged binding strips having respective axes;

(c) advancing means for advancing a strand of the coherent strips from said source along a predetermined path;

(d) severing means adjacent to said path and arranged to substantially simultaneously separate at least two binding strips from said strand to thereby form a group of discrete strips; and (e) transferring means for transferring a group of strips from said severing means to said binding station as a unit, said transferring means including removing means for removing the strips of a group from said path transversely of their axes, and spreading means for spreading the strips of a group in the axial direction of the strips.

35. The apparatus of claim 34, wherein said severing means is arranged in such a manner that the strips of a group formed by said severing means are substantially coaxial.

36. The apparatus of claim 35, wherein said removing means includes means for pushing successive groups of coaxial strips from said path at right angles to the axes of such strips.

37. The apparatus of claim 34, wherein said transferring means comprises a plurality of jaws arranged to engage successive groups of spread-apart binding strips, means for moving said jaws toward and away from each other, and means for moving said jaws simultaneously away from said binding station preparatory to engagement of such jaws with a group of spread-apart binding strips and toward said binding station preparatory to insertion of the binding strips of a group into the perforations of sheets of stacks at said station.

38. The apparatus of claim 37, wherein said transferring means comprises two jaws and said means for simultaneously moving said jaws includes means for transporting such jaws in a direction substantially at right angles to the axes of binding strips which are held by said jaws.

39. The apparatus of claim 38, wherein said jaws include portions which introduce the binding strips into and close the binding strips in the perforations of sheets of stacks at said station in response to movement of said jaws toward each other.

40. The apparatus of claim 34, wherein said advancing means is arranged to advance the strand in axial direction of the strips.

41. The apparatus of claim 34, wherein said spreading means is arranged to spread the strips of a group by moving at least one strip of the group away from a neighboring strip substantially axially.

42. The apparatus of claim 34, wherein said transferring means comprises introducing means for introducing the spread strips of a group into the perforations of at least one stack at said binding station.

43. The apparatus of claim 42, wherein said introducing means is arranged to close the strips after introduction thereof into the perforations of a stack.

44. The apparatus of claim 34, wherein said severing means is arranged to operate at intervals.

45. The apparatus of claim 34, wherein said source is arranged to supply substantially C-shaped binding strips.

46. The apparatus of claim 34, wherein said removing means is arranged to remove the strips of a group from said path in a direction substantially normal to the axes of the strips.

47. A system for conveying pronged binding strips from a source of the latter to a binding station for perforated stacks of sheets comprising:

(a) a pair of cooperating jaws;

(b) moving means for moving said jaws between said source and said station as a unit; and (c) shifting means for shifting at least one of said jaws towards and away from the other of said jaws so that said jaws can engage a binding strip in the region of said source, deliver the strip from said source to said station, and insert the strip into the perforations of a stack of sheets at said station.

48. The system of claim 47, wherein said jaws are designed to engage substantially C-shaped binding strips.

49. The system of claim 47, wherein said source comprises a conveyor.

50. The system of claim 47, wherein said moving means is arranged to move said jaws in first directions between said source and said station, said shifting means including means for moving said jaws in second directions substantially at right angles to said first directions.

51. The system of claim 50, wherein said moving means includes a carriage for said jaws and guide means for confining said carriage to translatory back-and-forth movements in said first directions, said jaws being movable relative to said carriage in said second directions.

52. The system of claim 47 for conveying C-shaped binding strips having predetermined configurations, wherein said jaws include strip-engaging guide elements having profiles complementary to the configuration of a binding strip between said jaws.

53. The system of claim 47, wherein said shifting means includes drive means for moving said jaws to a pluraltiy of positions with reference to each other.

54. The system of claim 53, wherein said drive means includes means for moving said jaws toward each other in a plurality of stages.

55. The system of claim 53, wherein said drive means includes means for repeatedly moving said jaws to predetermined closed positions in which a binding strip between said jaws is converted into a substantially tubular binder.

56. The system of claim 55, wherein said moving means of said drive means includes means for repeatedly moving the jaws to said closed positions in rapid sequence.

57. The system of claim 53, wherein said drive means comprises a movable cam and follower means operatively connected with said jaws and arranged to track said cam.

58. The system of claim 47, wherein each of said jaws comprises a substantially prismatic strip-engaging portion.

59. The system of claim 47, wherein said shifting means includes means defining for said jaws paths which makes an oblique angle.

60. The system of claim 47, wherein each of said jaws has a center line and at least one of said center lines crosses in space the axis of a binding strip which is held by said jaws.

61. The system of claim 47, wherein said jaws have center lines and such center lines intersect each other at a location other than on the axis of a binding strip between said jaws.

* * * * *